US008287721B1

(12) United States Patent
Paris-Marcano et al.

(10) Patent No.: US 8,287,721 B1
(45) Date of Patent: Oct. 16, 2012

(54) METHOD FOR REDUCING ASPHALTENE AND PARAFFIN CONTENT IN OIL MATERIAL

(76) Inventors: Lucinda Paris-Marcano, Maracaibo (VE); Maria Borjas-Garcia, Maracaibo (VE)

( * ) Notice: Subject to any disclaimer, the term of this patent is extended or adjusted under 35 U.S.C. 154(b) by 313 days.

(21) Appl. No.: 12/871,140

(22) Filed: Aug. 30, 2010

(51) Int. Cl.
*C10G 29/20* (2006.01)
*C10G 17/02* (2006.01)

(52) U.S. Cl. ..... 208/106; 208/208 R; 208/219; 208/224; 208/225

(58) Field of Classification Search ..... 208/106, 208/219, 252, 265, 390
See application file for complete search history.

(56) References Cited

U.S. PATENT DOCUMENTS 5,152,886 A 10/1992 Paris-Marcano

*Primary Examiner* — Walter D Griffin
*Assistant Examiner* — Derek Mueller
(74) *Attorney, Agent, or Firm* — Albert Bordas, P.A.

(57) ABSTRACT

A method for reducing asphaltene and paraffin content in oil material for recuperating and improving production of heavy, medium and light crude oils by reducing asphaltene and paraffin content in crude oil and oil-containing tar sands; and schist and clay for recuperation of exposed oxidized oil; and tar petroleum, schist petroleum, and clay petroleum, whereby a molecule elimination process of very polymerized hydrocarbons, including asphaltene and paraffin, are responsible for medium, heavy and extra heavy crude oil poor properties, as well as the difficult recuperation of most high containing long chain asphaltene and paraffin light crude oils, resulting in the production of more light and short hydrocarbon chains to greatly reduce viscosity, thus facilitating its recuperation and transportation.

18 Claims, No Drawings

METHOD FOR REDUCING ASPHALTENE AND PARAFFIN CONTENT IN OIL MATERIAL

BACKGROUND OF THE INVENTION

1. Field of the Invention

The present invention relates to methods for reducing asphaltene and paraffin content in oil material, and more particularly, to methods for recuperating and improving production of heavy, medium and light crude oils by reducing asphaltene and paraffin content in crude oil and oil-containing tar sands; and schist and clay for recuperation of exposed oxidized oil; and tar petroleum, schist petroleum, and clay petroleum.

2. Description of the Related Art

Presently, a serious problem in the petroleum industry is the scarceness of light crude oils and the diminution of production of light, as well as, medium and heavy crude oils. In some cases, difficult process surface extractions are more expensive than the crude oil itself. Additionally, heavy crude oils, having high concentrations of asphaltene that contain metals such as vanadium, nickel, iron, cobalt and sulfur, make this problem more serious. The recuperation of these crude oils is more difficult and costly every day because of the inefficient extraction, transportation and commercialization efforts. In addition, their distillation and/or use as fuel are also difficult due to the high pollution produced by the contained metals and sulfur.

Prior art teaches methods of injecting vapor mixed with different solvents for recuperating crude oils. However, these methods are limited because the crude oil can only be managed when it cools or when there is adequate solvent evaporation.

In addition, Applicant's own prior art U.S. Pat. No. 5,152,886 teaches a method for improving heavy crude oils by reducing the asphaltene content of crude oils and oil-containing tar sands. However, it differs from the present invention because Paris-Marcano teaches a process for reducing asphaltene content of crude oil and oil-containing materials to improve rheologidcal-properties of crude oils enhancing the water-extractabilities of Sulfur and metals contained in them. The process employs a cold cracking effect of a binary acid solution containing, preferably, hydrochloric acid and oleic acid. The process is particularly applicable to the exploitation of heavy and ultra-heavy oil deposits, to oil recovery from oil-containing tar sand, shale or clay and to the cleaning of oil tanks, garments and clogged oil-pipelines.

More specifically, Applicant's own prior art U.S. Pat. No. 5,152,886 teaches that to prepare the cold cracking composition, the liquid fatty acid and light organic solvent and optional emulsifying agent and optional petroleum-derived high molecular weight compound are mixed, and then the inorganic acid is slowly added to the liquid fatty acid/light organic solvent mixture while stirring vigorously. The thus produced cold cracking composition is mixed with an asphaltene-containing oil material and the resulting mixture is vigorously stirred or otherwise agitated at a temperature between room temperature and 80 degree Celsius. Preferably, this stirring or vigorous agitation of the mixture of the cracking solution and the asphaltene-containing oil material is carried out for about 1 to 10 minutes.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a method for reducing asphaltene and paraffin content in oil material by reducing asphaltene and paraffin content in crude oil and oil-containing tar sands that produce a cold cracking of crude oil's asphaltene and paraffin molecules, drastically reducing crude oil viscosity.

It is another object of this invention to provide a method for reducing asphaltene and paraffin content in oil material by reducing asphaltene and paraffin content in crude oil and oil-containing tar sands that improve the production of oil wells in very obstructed porosities due to asphaltene and paraffin precipitation, either of light or heavy crude with high, medium or low asphaltene and paraffin contains.

It is another object of this invention to provide a method for reducing asphaltene and paraffin content in oil material by reducing asphaltene and paraffin content in crude oil and oil-containing tar sands that improve the production of oil wells with low or null porosity, which produce by fracture due to their low permeability; cleaning fracture channels that could be obstructed by asphaltene and scales; and improving rock permeability.

It is another object of this invention to provide a method for reducing asphaltene and paraffin content in oil material by reducing asphaltene and paraffin content in crude oil and oil-containing tar sands that, in oil wells where a cracking solution has been "injected" from its main tubing, for completely cleaning the tubing entirely until intervals open to a production face formation to eliminate asphaltene and paraffin precipitated by the oil well's pressure and temperature changes.

It is another object of this invention to provide a method for reducing asphaltene and paraffin content in oil material by reducing asphaltene and paraffin content in crude oil and oil-containing tar sands that improves yield percentages in distilled (saturated) crude treated with a cracking solution.

It is another object of this invention to provide a method for reducing asphaltene and paraffin content in oil material by reducing asphaltene and paraffin content in crude oil and oil-containing tar sands that provides a mechanism for the recuperation of crude from deep and exhausted oil wells.

It is another object of this invention to provide a method for reducing asphaltene and paraffin content in oil material by reducing asphaltene and paraffin content in crude oil and oil-containing tar sands that provide a method for the recuperation of crude from clay or tar sands.

It is another object of this invention to provide a method for reducing asphaltene and paraffin content in oil material by reducing asphaltene and paraffin content in crude oil and oil-containing tar sands that eliminate sulfide and metals contained in the heavy crude asphaltene.

It is another object of this invention to provide a method for reducing asphaltene and paraffin content in oil material by reducing asphaltene and paraffin content in crude oil and oil-containing tar sands that unclogs pipes clogged by the asphaltene and/or paraffin.

It is another object of this invention to provide a method for reducing asphaltene and paraffin content in oil material by reducing asphaltene and paraffin content in crude oil and oil-containing tar sands that provides a mechanism to eliminate water-oil emulsions.

It is another object of this invention to provide a method for reducing asphaltene and paraffin content in oil material by reducing asphaltene and paraffin content in crude oil and oil-containing tar sands that provides a means to eliminate water contained in the oil wells.

It is yet another object of this invention to provide such a method that is inexpensive to implement and operate while being effective.

Further objects of the invention will be brought out in the following part of the specification, wherein detailed description is for the purpose of fully disclosing the invention without placing limitations thereon.

DETAILED DESCRIPTION OF THE PREFERRED EMBODIMENT

The present invention relates to a molecule elimination process of very polymerized hydrocarbons, including asphaltene and paraffin, which are responsible for medium, heavy and extra heavy crude oil poor properties, as well as the difficult recuperation of most high containing long chain asphaltene and paraffin light crude oils. In operation, the method of the present invention produces more light and short hydrocarbon chains to greatly reduce viscosity, thus facilitating its recuperation and transportation.

Under predefined and suitable experimental conditions, a organic acid—inorganic acid solution, defined as a cracking solution, is able to produce cold cracking of high molecular weight asphaltene and/or paraffin molecules contained in oil. Oleic acid is especially important to crude treatment. The chemical relationship between oleic acid and hydrocarbon oil is such that, oleic acid interacts with crude to produce an unexpected effect but with highly beneficial effects. This observation was used to combine oleic acid with hydrochloric acid and a solvent (kerosene, xylene, oil gas, limonene (orange skin oil), among others) to obtain the cracking solution that favorably modifies asphaltene and/or paraffin high contents crude properties.

Oleic acid has eight known isomers that basically consist of an olefinic chain with carboxylic groups. Its chemical formulation is as follows:

$$CH_3—(CH_2)_x—CH=CH—(CH_2)_y—COOH$$

The addition of hydrochloric acid (HCl) to the oleic acid forms a conductive mixture for the transformation of oleic in one or more isomers. Shaking this mixture exposes isomers to the air, which results in oxidized isomers. During oxidation, the oleic acid's isomers double bonding characteristic is broken. First, weak hydroxy-acids, and then another decomposition occurs, producing aliphatic chains with synthesis in mono and di-carboxyl, groups, for example:

$$CH_3(CH_2)_xCH=CH(CH_2)_yCOOH \text{ air} \quad (2)$$

$$CH_3(CH_2)_x—CHOH=CHOH(CH_2)_y—COOH \text{ air} \quad (3)$$

$$CH_3(CH_2)_n—COOH/HOOC(CH_2)_n—COOH \quad (4)$$

These oxidation and reduction equations, in combination with hydrochloric acid (HCl), play an important role in the treatment of heavy crude. In particular, when the cracking solution, the oleic acid—hydrochloric acid solution, contacts crude containing a high percent of high molecular weight asphaltene and/or paraffin, the hydrochloric acid rapidly attacks and breaks asphaltene and/or paraffin long and complex hydrocarbon chains, forming hydrocarbon short chains. It considerably decreases crude viscosity, permitting its complex liquefaction. Sulfur and metals are simultaneously released, because they are trapped in macromolecules metal-porphyrinic present in the crude. When the cracking of these molecules occurs, metals and sulfur are released, going through the aqueous phase in the oil well. The cracking solution acts as a vehicle to facilitate the free flow of the crude, when the solvents are limonene (orange skin oil), xylene, toluene, and others mentioned before. For gas-oil or kerosene, an interaction in the asphaltene and/or paraffin molecules breaking fundamental reactions is observed. These components form a new compound when they react with acids, forming a very powerful cracking solution that is able to break big molecules of asphaltene and paraffin, at the same time generate a chain reaction. While several oxidation and reduction reactions occur, a great amount of carbonium ions are generated. In addition, carbonium ions react with oleic acid's olefinic chains when the hydrocarbonated chains of crude are present, transforming olefins in alkane and aromatic hydrocarbons, which were in the volume of the original crude that was exposed to the cracking solution.

Some reactions that occurred with the cracking solution included observation of separated asphaltene molecules with analysis equipment having carbon 13 $C^{13}$.

The percentage in weight of the inorganic acid is between 0.1 and 15% for the cracking solution, preferably between 0.5 and 5%. The organic acid is between 1.0 and 99% in the composition of the cracking solution, preferably between 30 and 60%. The light organic solvent is between 20 and 80% in the cracking solution composition volume, preferably between 15 and 55% of the cracking solution.

The present invention is a proven method, evidenced by the following examples:

EXAMPLE I 250 ml of Venezuelan crude oil (TJ 780) was deposited in four beakers of 600 ml each. For comparison, a cracking solution of the present and a comparative treatment under prior art U.S. Pat. No. 5,152,886 is shown in Table 1. Added to beakers in an amount enough to provide a final concentration of 5, 10, 15 or 20% v/v. The mixture is let to react. The results were:

TABLE 1

| | % Addition | API | % ASF | % $H_2O$ | Pour Point | Viscosity Centipoise | % S | % Metals |
|---|---|---|---|---|---|---|---|---|
| Before | | 12.13 | 13.6 | 0.1 | −1.0 | 3500 | 2.2 | 1.3 |
| After | 5% | 16.7 | 7.3 | 20.1 | −1.0 | 107 | 1.0 | 1.2 |
| | 10% | 19.9 | 0.95 | 0.0 | −23 | 60,46 | 0.8 | 1.0 |
| | 15% | 19.9 | 0.95 | 0.0 | −23 | 60,46 | 0.8 | 1.0 |
| | 20% | 19.9 | 0.95 | 0.0 | −23 | 60,46 | 0.8 | 1.0 |
| Comparative treatment with prior art U.S. Pat. No. 5,152,886 | | | | | | | | |
| After | 5% | 14.3 | 8.2 | 0.1 | −1.0 | 365 | 1.4 | 1.2 |
| | 10% | 16.7 | 4.2 | 0.1 | −14 | 114 | 1.4 | 1.0 |
| | 15% | 18.8 | 1.5 | 0.1 | −18 | 107 | 1.0 | 1.0 |
| | 20% | 19.0 | 1.2 | 0.1 | −20 | 87 | 1.0 | 1.0 |

EXAMPLE 2

The procedure of Example I was repeated using 2 liters of crude from Boscan Field, adding 10% in weight of the cracking solution of the present application according to Table II and shaken for 5 minutes. The results were:

TABLE 2

| COMPOSITION OF BOSCAN CRUDE | | | | |
|---|---|---|---|---|
| | API at 60° F. | Asphaltene (%) | H2O | Viscosity at 140° F. (Centipoise) |
| Before treatment | 10.0 | 36.6 | 18.0 | 3.600 |
| After treatment | 18.8 | 2.0 | 3.2 | 62 |

EXAMPLE 3

A Venezuelan crude identified as LL-2744 was directly treated in the oil well with a chemical stimulation. The results were:

TABLE 3

| | Bbl Prod. | Asphalt. (%) | API at 60° F. | $H_2O$ | Viscosity at 140° F. (Centipoise) |
|---|---|---|---|---|---|
| Before injection | 5.0 | 5.84 | 19.5 | 4.0 | 92.72 |
| After injection | 78.0 | 0.00 | 23.7 | 0.0 | 32.81 |

EXAMPLE 4

A Venezuelan crude identified as TJ-883 was directly stimulated to in the oil well. The results were:

TABLE 4

| | Bbl Prod. | Asphalt. (%) | API at 60° F. | $H_2O$ | Viscosity at 140° F. (Centipoise) |
|---|---|---|---|---|---|
| Before injection | 40.0 | 1.20 | 15.0 | 24.0 | 155.35 |
| After injection | 180.0 | 0.40 | 19.4 | 2.0 | 93.05 |

EXAMPLE 5

A Venezuelan crude identified as oil well UD-319 was directly stimulated through the head of the pipe. The results were:

TABLE 5

| | Bbl Prod. | Asphalt. (%) | API at 60° F. | $H_2O$ | Viscosity at 140° F. (Centipoise) |
|---|---|---|---|---|---|
| Before injection | 30.0 | 10.6 | 8.0 | 1.2 | 11,347.70 |
| After injection | 275.0 | 3.4 | 19.2 | 0.0 | 505.27 |

Note:
Bbl Prod=Production Barrels
% Asphalt.=% Asphaltene
API=API gravity

Hydrofluoric acid is incorporated to the cracking solution in reservoirs wherein crude oil is trapped in limestone formations. Under these conditions, the oil well needs to be fractured due to the low or null porosity and permeability. The cracking solution cleans the reservoir from limestone and/or asphalt deposits, allowing the crude oil to flow and ascend. This cracking solution is directly injected to the candidate to stimulate oil wells, considering previous analysis such as asphaltene and paraffin contains and production decline. Other details should be considered, such as porosity, permeability, sands open to production, tubing, depth, pressure of the reservoir, among others.

As noted above, the present application was tested as a private investigation project in a representative amount of oil wells in Venezuela by the Company of Petroleum of Venezuela (PDVSA). The tested oil wells had notably declined their production, had very heavy crude oil with asphaltene high contains.

The authorization and funding for this investigation project was provided to the inventor for the following reasons:

The tested oil wells were almost closed and had high maintenance expenses.

These tests and investigation study were performed with the help of the team of PDVSA's Reservoirs and Productions in Tia Juana Lake area, western region of Zulia State.

Once the cracking solution is added to crude oils, it does not affect the distillation process. On the contrary, with the use of the cracking solution, metals and sulfur, which affect catalyzers used in the oil distillation, separate. Once separated, metals and sulfur go through the aqueous phase. During the aqueous phase, crude oil is "washed" after extraction and before storage and distribution. The present invention may be used in containers, where medium and heavy crude oils are stored. However, the direct stimulation of the oil wells has been found as its best application. In addition, oil wells elevated pressure and temperature conditions accelerate the reaction between the crude oil and the cracking solution. Once the oil well is chemically stimulated, an enhanced crude oil is obtained, the breaking of the obstructing asphaltene and paraffin molecules is accelerated and the production is notable increased. In some oil wells, the production showed an increase of 1500%, in others 200% and 300%, as evidenced in the results of the oil wells stimulations defined above as "Examples".

Therefore, the present invention is a method for reducing asphaltene and paraffin content in oil material, comprising the steps of preparing a cracking solution comprising an inorganic acid and an organic acid. The inorganic acid and the organic acid are heated together to a temperature between 80°-100° Celsius maximum, then cooled to ambient temperature. The inorganic acid is selected from the group consisting of hydrochloric acid, hydrofluoric acid, diluted sulfuric acid, phosphoric acid, or a mixture thereof; and applying the cracking solution to oil material comprising asphaltene and paraffin, whereby molecule cracking occurs defining stimulation, thus reducing macromolecules resulting in a lighter crude oil resulting in increased oil production.

The organic acid is selected from the group consisting of oleic acid, linoleic acid, linolenic acid, or a mixture thereof. The inorganic acid and the organic acid are sole acids in the cracking solution. A measured percentage of the inorganic acid and the organic acid are in a range from 0.1:15 to 0.1:99. The cracking solution further comprises an emulsifier agent and an oil derivative compound of high molecular weight. The oil derivative compound of high molecular weight is gas oil. The cracking solution further comprises a light organic solvent. The light organic solvent is selected from the group consisting of kerosene, gasoline, benzine, limonene (orange skin oil), xylene, insol, toluene, or a mixture thereof. The inorganic acid is hydrochloric acid. The organic acid is oleic acid, and the cracking solution may contain an emulsified agent and gas oil.

The cracking solution attacks and breaks asphaltene and/or paraffin long and complex hydrocarbon chains, forming hydrocarbon short chains. The cracking solution decreases crude viscosity, permitting liquefaction. Trapped sulfur and metals from macromolecules present in the crude oil are released when the molecule cracking occurs. A reduction of viscosity of the oil material comprising asphaltene and paraffin is realized, and a reduction of contained water is realized. A reduction of water-oil emulsion is also realized. The cracking solution produces an increase of American Petroleum Institute ("API") gravity. The oil material includes tar sands, schist, or clay for recuperation of exposed oxidized oil. The oil material includes tar petroleum, schist petroleum, or clay petroleum, whereby the cracking solution reacts with the oil material at an ambient temperature to separate and recover the oil that had lost its primary physical-chemical properties due to time exposed to the ambient temperature.

One of the preferred embodiments for the formulation of the used cracking solution is shown in Table A, as follows:

TABLE A

| COMPOSITION OF THE CRACKING SOLUTION IN WEIGHT (%) | |
|---|---|
| Hydrochloric Acid (HCl, d = 1.19 g/ml) | 1.5% |
| Oleic acid + Linoleic acid | 40.0% |
| Light solvent | 58.5% |

Another embodiment for the formulation of the cracking solution is shown in Table B, as follows:

TABLE B

| COMPOSITION OF THE CRACKING SOLUTION IN WEIGHT (%) | |
|---|---|
| Hydrochloric acid (HCl, d = 1.19 g/ml) | 1.0% |
| Hydrofluoric acid (HF d = 1.0 g/ml) | 1.0% |
| Oleic acid + Linoleic acid | 40.0% |
| Light solvent | 58.0% |

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A method for reducing asphaltene and paraffin content in oil material, comprising the steps of:

A) preparing a cracking solution comprising an inorganic acid and an organic acid, said inorganic acid and said organic acid are heated together to a temperature between 80°-100° Celsius maximum, then cooled to ambient temperature, said inorganic acid is selected from the group consisting of hydrochloric acid, hydrofluoric acid, diluted sulfuric acid, phosphoric acid, or a mixture thereof; and B) applying said cracking solution to oil material comprising asphaltene and paraffin, whereby molecule cracking occurs, thus reducing macromolecules resulting in a lighter crude oil resulting in increased oil production.

2. The method for reducing asphaltene and paraffin content in oil material set forth in claim 1, further characterized in that said organic acid is selected from the group consisting of oleic acid, linoleic acid, linolenic acid, or a mixture thereof.

3. The method for reducing asphaltene and paraffin content in oil material set forth in claim 1, further characterized in that said inorganic acid and said organic acid are sole acids in said cracking solution.

4. The method for reducing asphaltene and paraffin content in oil material set forth in claim 1, further characterized in that a measured percentage of said inorganic acid and said organic acid are in a range from 0.1:15 to 0.1:99.

5. The method for reducing asphaltene and paraffin content in oil material set forth in claim 1, further characterized in that said cracking solution further comprises an emulsifier agent and an oil derivative compound of high molecular weight.

6. The method for reducing asphaltene and paraffin content in oil material set forth in claim 5, further characterized in that said oil derivative compound of high molecular weight is gas oil.

7. The method for reducing asphaltene and paraffin content in oil material set forth in claim 1, further characterized in that said cracking solution further comprises a light organic solvent.

8. The method for reducing asphaltene and paraffin content in oil material set forth in claim 7, further characterized in that said light organic solvent is selected from the group consisting of kerosene, gasoline, benzine, limonene (orange skin oil), xylene, insol, toluene, or a mixture thereof.

9. The method for reducing asphaltene and paraffin content in oil material set forth in claim 1, further characterized in that said inorganic acid is hydrochloric acid, said organic acid is oleic acid, and said cracking solution may contain an emulsified agent and gas oil.

10. The method for reducing asphaltene and paraffin content in oil material set forth in claim 1, further characterized in that said cracking solution attacks and breaks asphaltene and/or paraffin long and complex hydrocarbon chains, forming hydrocarbon short chains.

11. The method for reducing asphaltene and paraffin content in oil material set forth in claim 1, further characterized in that said cracking solution decreases crude viscosity, permitting liquefaction.

12. The method for reducing asphaltene and paraffin content in oil material set forth in claim 1, further characterized in that trapped sulfur and metals from macromolecules present in said crude oil are released when said molecule cracking occurs.

13. The method for reducing asphaltene and paraffin content in oil material set forth in claim 1, further characterized in that a reduction of viscosity of said oil material comprising asphaltene and paraffin is realized.

14. The method for reducing asphaltene and paraffin content in oil material set forth in claim 1, further characterized in that a reduction of contained water is realized.

15. The method for reducing asphaltene and paraffin content in oil material set forth in claim 1, further characterized in that a reduction of water-oil emulsion is realized.

16. The method for reducing asphaltene and paraffin content in oil material set forth in claim 1, further characterized in that said cracking solution produces an increase of API gravity.

17. The method for reducing asphaltene and paraffin content in oil material set forth in claim 1, further characterized in that said oil material includes tar sands, schist, or clay for recuperation of exposed oxidized oil.

18. The method for reducing asphaltene and paraffin content in oil material set forth in claim 1, further characterized in that said oil material includes tar petroleum, schist petroleum, or clay petroleum, whereby said cracking solution reacts with said oil material at an ambient temperature to separate and recover said oil that had lost its primary physical-chemical properties due to time exposed to said ambient temperature.

* * * * *